United States Patent [19]

Law

[11] Patent Number: 4,545,776

[45] Date of Patent: Oct. 8, 1985

[54] STEERING MECHANISM FOR SELF-POWERED VEHICLES AND VEHICLES EMPLOYING SAID STEERING MECHANISM

[75] Inventor: Nin Y. Law, Kowloon, Hong Kong

[73] Assignee: Soma Traders Ltd., Kowloon, Hong Kong

[21] Appl. No.: 507,343

[22] Filed: Jun. 24, 1983

[51] Int. Cl.[4] ..... A63H 29/00

[52] U.S. Cl. ..... 446/443; 446/454; 446/460

[58] Field of Search ..... 46/262, 210, 213, 251, 46/253, 255, 257, 258, 259, 263; 446/443, 454, 460, 462, 437, 455, 456

[56] References Cited

U.S. PATENT DOCUMENTS

| | | | |
|---|---|---|---|
| 412,298 | 10/1889 | Samuel | 105/119 |
| 417,182 | 12/1889 | Hippard | 49/357 |
| 425,077 | 4/1890 | Hunter | 105/118 |
| 448,910 | 3/1891 | Conradson | 105/119 |
| 1,627,150 | 5/1927 | De Filippis | 46/213 |
| 1,808,766 | 6/1931 | De Filippis | 46/213 |
| 2,104,365 | 1/1938 | Fuchs | 46/211 |
| 2,172,416 | 9/1939 | Swenson | 46/213 |
| 2,366,122 | 12/1944 | Merce | 74/298 |
| 2,404,186 | 7/1946 | Mariani | 46/103 |
| 2,488,464 | 11/1949 | Arpin | 446/443 |
| 2,606,402 | 8/1952 | Fuchs | 46/211 |
| 3,050,904 | 8/1962 | Morse | 46/213 |
| 3,243,917 | 4/1966 | Giammarino et al. | 46/243 |
| 3,264,781 | 8/1965 | Hok-Shou | 46/244 |
| 3,797,404 | 3/1974 | Barlow et al. | 46/259 X |
| 3,810,515 | 5/1974 | Ingro | 46/239 X |
| 3,871,129 | 3/1975 | Tong | 46/262 |
| 3,909,276 | 9/1975 | Wolf | 46/262 X |
| 4,232,479 | 11/1980 | von Winckelmann | 46/262 |
| 4,248,012 | 2/1981 | Kirby et al. | 46/262 |
| 4,276,717 | 7/1981 | Zbriger et al. | 46/262 |
| 4,380,135 | 4/1983 | Wildman et al. | 46/251 X |
| 4,443,968 | 4/1984 | Law | 46/251 |

FOREIGN PATENT DOCUMENTS

| | | | |
|---|---|---|---|
| 1965028 | 7/1971 | Fed. Rep. of Germany | 446/454 |
| 848085 | 10/1959 | France | 446/436 |
| 1193861 | 11/1959 | France | 446/454 |
| 2103946 | 3/1983 | United Kingdom | 46/262 |

*Primary Examiner*—Mickey Yu

*Attorney, Agent, or Firm*—Buell, Ziesenheim, Beck & Alstadt

[57] ABSTRACT

A steering mechanism for self-powered vehicles and vehicles employing this mechanism are disclosed. The steering mechanism is characterized by a yoke pivotably attached to the vehicle frame which carries one of the vehicle's axles. A crown gear is provided on the axle which engages a spur gear mounted on the yoke in a position substantially perpendicular to the crown gear. The spur gear is connected through a drive train to a reversible motor. Stops are provided on the frame or yoke which hold the axle substantially parallel to the vehicle's other axle when the motor is turning in a given direction. Then the axle is positioned so that the vehicle will travel in a straight line. When the motor is reversed the stops will allow the yoke and attached axle to pivot to a postion where the axles are no longer parallel and the vehicle will turn.

17 Claims, 5 Drawing Figures

STEERING MECHANISM FOR SELF-POWERED VEHICLES AND VEHICLES EMPLOYING SAID STEERING MECHANISM

FIELD OF INVENTION

The invention relates to a steering mechanism for self-powered vehicles which enables the vehicle to turn as well as move in a straight line and vehicles employing this steering mechanism. The mechanism is particularly useful for toy vehicles.

PRIOR ART

Several mechanisms have been developed for steerable toy vehicles. One common means is to provide a link attached at one end to the front axle. The other end of the link is attached to a cam or similar device which causes the link to oscillate. The oscillating link pushes and pulls one end of the axle forward and backward thus enabling the vehicle to turn. Merce in U.S. Pat. No. 2,366,122 discloses a link steering system which is controlled by manually turning a steering wheel. That system is impractical for a miniature vehicle. DeFilippis in U.S. Pat. No. 1,627,150 discloses a link steering system controlled by a motor driven circular gear. The disadvantage of this system is that the vehicle will only travel in a predetermined path.

Another mechanism used for steerable vehicles involves the use of a single drive wheel mounted in the center of the vehicle. The single wheel is mounted in such a way that movement of a push rod will cause the drive wheel to pivot and the vehicle to turn. Such a system is disclosed in Fuchs U.S. Pat. No. 2,606,402. One disadvantage of this system is that the single drive wheel makes the vehicle appear less realistic. Another problem is that one has limited control over the steering of the vehicle.

OBJECTS OF THE INVENTION

The object of the present invention is to provide a steering mechanism for toy vehicles which is suitable for miniature vehicles of approximately three inches in length.

A further object of the invention is to provide a steering mechanism which can be used for a four wheel drive vehicle.

Another object of the invention is to provide a steering mechanism which will enable a child playing with the vehicle to be able to steer the vehicle.

A still further object of the invention is to provide a steering mechanism which is durable, reliable, and relatively inexpensive to manufacture.

DESCRIPTION OF THE PREFERRED EMBODIMENTS

I prefer to provide a steerable four wheel drive vehicle which is propelled by a reversible motor. The steering mechanism is comprised of an axle having wheels at either end and a crown gear therebetween. The axle is located on the frame between two pairs of stops which permit the axle to pivot between the stops. A yoke is fitted over the axle and a gear is attached to the yoke. This gear engages and is substantially parallel to the crown gear. A drive shaft with a worm at its outer end extends from the motor to engage and drive the gear attached to the yoke. A torque will develop in the crown gear on the axle when the motor is activated. That force will push the axle forward or backward depending upon the direction of rotation of the gears. The direction of rotation will change when the motor is reversed. The stops on the frame will limit movement of the axle. Those stops are positioned so that when the motor is operating in one direction the axle will be in a position to cause the vehicle to move in a straight line. When the motor is reversed the axle will move between the stops until the axle is in a position where the vehicle will turn. Thus, one can steer the vehicle by changing the direction of the motor. Other details and objects of the invention will become apparent from the following description of the drawings of a present preferred embodiment of the invention.

Figure 3:
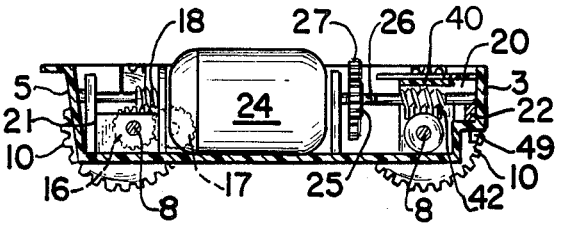
FIG. 3 is a side view taken along the line III—III of FIG. 1.

Referring to the drawings a generally rectangular frame 1 having a base 2 and four vertical side walls 3, 4, 5 and 6 is provided. A rear axle 8 having wheels 10 at both ends is fitted onto the frame through slots 12 and 13 in walls 4 and 6. A clevice or similar structure 14 is provided to hold the rear axle 8 in place. The rear axle 8 is driven through a spur gear 16 attached to the axle. The spur gear engages a second spur gear 17 on the frame which is driven by worm 18 on propeller shaft 20. The propeller shaft extends the length of the frame and is held in place by mountings 21 and 22 (See FIG. 3). A reversible motor 24 is positioned on the frame 1 preferably to the rear of center for best balance. The motor is powered by an external power source 30 having forward and reverse buttons 32 and 34. I prefer to use two AA size dry cell batteries to power the vehicles. These batteries shown by dotted lines are contained in the power source 30. If desired, other size batteries or other electrical power sources could be used. Wires 36 connect the motor to the power source 30.

Figure 5:
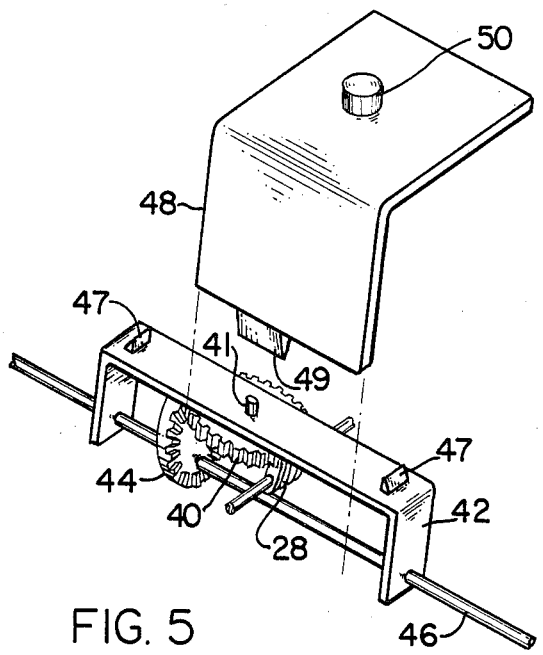
FIG. 5 is a partially exploded detail view of the steering mechanism.

A gear 25 is attached to the drive shaft 26 which extends from the motor 24. Gear 25 engages gear 27 on propeller shaft 20. A second worm gear 28 is provided at the front end of the propeller shaft 20. This worm gear 28 engages a horizontally disposed gear 40 attached by pin 41 to a yoke 42 which is fitted over and attached at opposite ends thereof directly to the front axle 46 (See FIG. 5). Gear 40 continuously engages and is substantially perpendicular to a crown gear 44 on the front axle 46. A cover 48 is fitted over the yoke and held in place on the frame by tab 49. A receptacle 50 is provided in the cover 48 to receive pin 41. Thus, the yoke 42, which is wider than cover 48, is pivotally attached at a location intermediate the ends thereof to the frame. Tabs 47 may be provided on yoke 42 to limit lateral movement and the degree to which the yoke may turn.

Figure 1:
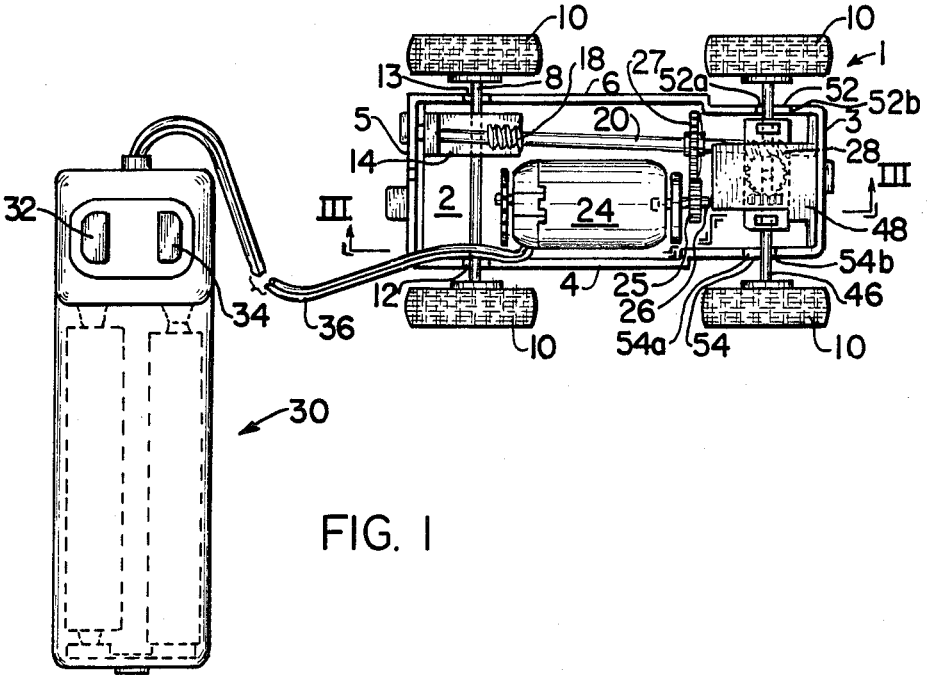
FIG. 1 is a top plan view of a toy vehicle having a present preferred embodiment of my steering mechanism.
Figure 4:
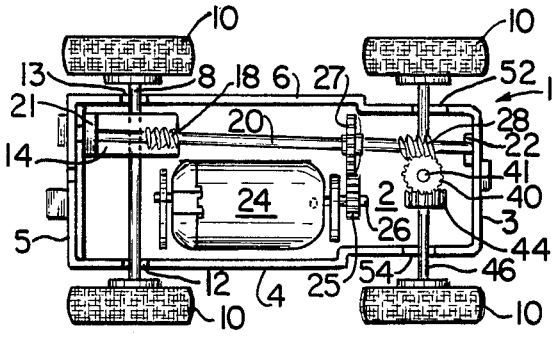
FIG. 4 is a top plan view of the embodiment of FIG. 1 after the axle cover has been removed.

Referring to FIGS. 1 and 4 the front axle 46 is fitted into slots 52 and 54 in sides 4 and 6. These slots are larger than the diameter of the axle 46 and positioned so that when the axle 46 rests against the rear wall **52*a* of slot 52 and the front wall 54*b* of slot 54 the axle will be substantially parallel to front wall 3 and the vehicle will travel in a straight line. When the axle 46 rests against the front wall 52***b* of slot 52 and the rear wall 54*a* of slot 54 the vehicle will turn.

When the motor 24 is running a torque will be created in the action of gear 40 on crown gear 44. The direction of this force will tend to push the crown gear 44 and attached front axle 46 either forward or backward depending upon the direction of rotation of gear 40. The side walls of slots 52 and 54 act as stops to prevent the axle from moving beyond a desired point. Thus, by reversing the motor one can cause the front axle to turn thereby causing the vehicle to turn. A child playing with the toy vehicle can cause the vehicle to turn simply by pressing the reverse button on the power unit. He may do this whenever and as often as he wishes.

In the present preferred embodiment I have shown that one can use misaligned slots 52 and 54 to limit the turning of the front axle. One may provide stops extending from cover 48 between which projections (such as tab 47) extending from yoke 42 can move. These cover stops would be equivalent to the side walls of slots 52 and 54. In another embodiment the side walls 4 and 6 could be eliminated and stops could be placed on the base 2 at points now occupied by the side walls of slots 52 and 54.

Figure 2:
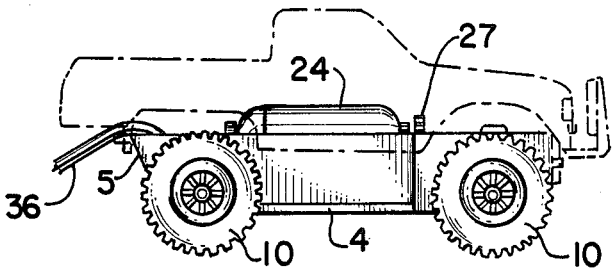
FIG. 2 is a side view of the embodiment of FIG. 1 with a vehicle body attached.

As shown in FIG. 2, I prefer to place a vehicle body over the frame to conceal the motor, gears, yoke, axles and drive train. I further prefer to use a body which is a scale model of a full size vehicle body. If desired this body could be a composite of several vehicle bodies.

I further prefer to provide a miniature toy vehicle of approximately three inches in length. When a full size vehicle is compared to my vehicle the scale used is preferably in the range 45:1 to 60:1.

If desired the vehicle wheels may be made overscale to provide a macho look frequently seen in full size four wheel drive vehicles. In such circumstances the wheels preferably are approximately two times overscale.

I have shown a four wheel drive vehicle. However, one may elect to provide power only to the front axle.

It is purely a matter of choice as to whether the axle which turns is placed in the front or rear of the vehicle. Thus, when I speak of "front" or "rear" it is to be understood that these terms are used merely as a matter of convenience, and that one may choose to orient the vehicle opposite the manner in which I have illustrated.

Although I have shown a dry cell power supply for the vehicle one may choose to use an electrified track and provide contacts on the vehicle for supplying power from the track to the motor.

While I have described and illustrated a present preferred embodiment of my steering mechanism and steerable vehicle it is to be distinctly understood that my invention is not limited thereto, but may be variously embodied within the scope of the following claims.

I claim:

1. A steering mechanism for vehicles of the type having a frame, a rear axle attached to the frame and having at least one wheel attached thereto, a front axle having wheels at either end, a reversible motor mounted on the frame, a power supply connected to the motor and a drive train for delivering power from the motor to at least one axle comprising:

(a) a crown gear mounted on the front axle between the wheels, (b) a yoke fitted over and attached at opposite ends thereof directly to the front axle;

(c) a spur gear attached to the yoke in a manner so that it continuously engages and is substantially perpendicular to the crown gear and is connected to and driven by the drive train;

(d) a mounting which pivotally attaches the yoke at a location intermediate the ends thereof to the frame thereby enabling the axle to pivot relative to the frame; and (e) spaced apart first and second stops mounted on each side of the frame so that the spacing in each pair of stops is wider than the front axle and positioned so that when the motor is turning in a forward direction the front axle rotates in a forward direction, abuts the first stops on each side of the frame and is substantially parallel to the rear axle causing the vehicle to move forward in a substantially straight line, and when the rotation of the motor is reversed a torque acting on the spur gear and attached yoke will cause the yoke and attached front axle to pivot to a position where the front axle rests against the second stops on each side of the frame and is not parallel to the rear axle and will cause the front axle to rotate in a backward direction causing the vehicle to move in a backward direction and turn.

2. The vehicle of claim 1 also comprising:

(a) a remote control unit having a receptacle for at least one dry cell battery and a switch; and (b) a wire connecting the remote control unit to the motor.

3. A steerable vehicle comprised of:

(a) a frame;

(b) a rear axle having wheels at either end rotatably attached to the frame;

(c) a front axle having wheels at either side and a crown gear therebetween;

(d) a yoke fitted over and attached at opposite ends thereof directly to the front axle;

(e) a spur gear attached to the yoke in a manner so that it continuously engages and is substantially perpendicular to the crown gear;

(f) a mounting which pivotally attaches the yoke at a location intermediate the ends thereof to the frame thereby enabling the axle to pivot relative to the frame;

(g) a reversible motor mounted on the frame; and (h) a drive train to deliver power from the motor to the spur gear; and (i) spaced apart first and second stops mounted on each side of the frame so that the spacing in each pair of stops is wider than the front axle and positioned so that when the motor is turning in a forward direction the front axle rotates in a forward direction, abuts the first stops on each side of the frame and is substantially parallel to the rear axle causing the vehicle to move forward in a substantially straight line, and when the rotation of the motor is reversed a torque acting on the spur gear and attached yoke will cause the yoke and attached front axle to pivot to a position where the front axle rests against the second stops on each side of the frame and is not parallel to the rear axle and will cause the front axle to rotate in a backward direction causing the vehicle to move in a backward direction and turn.

4. The toy vehicle of claim 2 also comprising:

(a) a rear axle spur gear attached to the rear axle;
(b) a second spur gear mounted on the frame and engaging the rear axle spur gear; and
(c) a worm gear attached to a propeller shaft and engaging the second spur gear.

5. The vehicle of claim 3 also comprising a vehicle body mounted to the frame, said body concealing the motor, gears, yoke and drive train.

6. The vehicle of claim 5 wherein the body is a scale model derived from at least one real vehicle body and the wheels are spaced apart to generally match the wheel spacing of such real vehicle at the scale used.

7. The vehicle of claim 6 wherein the scale used is in the range of 45:1 to 60:1.

8. The vehicle of claim 6 wherein the wheels are roughly two times overscale.

9. A steerable vehicle comprised of:
(a) a frame;
(b) a rear axle having wheels at either end and rotatably attached to the frame;
(c) a front axle having wheels at either side and a crown gear therebetween;
(d) a yoke fitted over and attached at opposite ends thereof directly to the front axle;
(e) a spur gear attached to the yoke in a manner so that it continuously engages and is substantially perpendicular to the crown gear;
(f) a mounting which pivotally attaches the yoke at a location intermediate the ends thereof to the frame thereby enabling the axle to pivot relative to the frame;
(g) a reversible motor mounted to the frame;
(h) a drive train to deliver power from the motor to the spur gear; and
(i) spaced apart first and second stops mounted on each side of the frame so that the spacing in each pair of stops is wider than the front axle and positioned so that when the motor is turning in a forward direction the front axle rotates in a forward direction, abuts the first stops on each side of the frame and is substantially parallel to the rear axle causing the vehicle to move forward in a substantially straight line, and when the rotation of the motor is reversed a torque acting on the spur gear and attached yoke will cause the yoke and attached front axle to pivot to a position where the front axle rests against the second stops on each side of the frame and is not parallel to the rear axle and will cause the front axle to rotate in a backward direction causing the vehicle to move in a backward direction and turn.

10. The vehicle of claim 9 also comprising
(a) a remote control unit having a receptacle for at least one dry cell battery and a switch; and
(b) a wire connecting the remote control unit to the motor.

11. The vehicle of claim 9 also comprising a vehicle body mounted to the frame, said body concealing the motor, gears, yoke and drive train.

12. The vehicle of claim 11 wherein the body is a scale model derived from at least one real vehicle body and the wheels are spaced apart to generally match the wheel spacing of such real vehicle at the scale used.

13. The vehicle of claim 12 wherein the scale used is in the range from 45:1 to 60:1.

14. The vehicle of claim 12 wherein the wheels are roughly two times overscale.

15. A steering mechanism for vehicles of the type having a frame, a rear axle attached to the frame and having at least one wheel attached thereto, a front axle having wheels at either end, a reversible motor mounted on the frame and a power supply connected to the motor comprising:
(a) a crown gear mounted on the front axle between the wheels;
(b) a yoke fitted over the front axle;
(c) a spur gear attached to the yoke in a manner so that it engages and is substantially perpendicular to the crown gear and is connected to and driven by the drive train;
(d) a mounting which pivotally attaches the yoke to the frame thereby enabling the axle to pivot relative to the frame;
(e) a drive train for delivering power from the motor to at least one axle, said drive train further comprising:
(i) a driveshaft extending from the motor substantially perpendicular to the rear axle;
(ii) a first spur gear mounted on the driveshaft;
(iii) a propeller shaft parallel to the driveshaft;
(iv) a second spur gear mounted on the propeller shaft so as to engage the first spur gear; and
(v) a worm gear attached to the propeller shaft and engaging the spur gear on the yoke,
(f) spaced apart first and second stops mounted on each side of the frame so that the spacing in each pair of stops is wider than the front axle and positioned so that when the motor is turning in a forward direction the front axle rotates in a forward direction, abuts the first stops on each side of the frame and is substantially parallel to the rear axle causing the vehicle to move forward in a substantially straight line, and when the rotation of the motor is reversed a torque acting on the spur gear and attached yoke will cause the yoke and attached front axle to pivot to a position where the front axle rests against the second stops on each side of the frame and is not parallel to the rear axle and will cause the front axle to rotate in a backward direction causing the vehicle to move in a backward direction and turn.

16. A steerable vehicle comprising:
(a) a frame;
(b) a rear axle having wheels at either end and rotatably attached to the frame;
(c) a front axle having wheels at either side and a crown gear therebetween;
(d) a yoke fitted over the front axle;
(e) a spur gear attached to the yoke in a manner so that it engages and is substantially perpendicular to the crown gear;
(f) a mounting which pivotally attaches the yoke to the frame thereby enabling the axle to pivot relative to the frame;
(g) a reversible motor mounted to the frame;
(h) a drive train to deliver power from the motor to the spur gear said drive train further comprising:
(i) a driveshaft extending from the motor substantially perpendicular to the rear axle;
(ii) a first spur gear mounted on the driveshaft;
(iii) a propeller shaft mounted on the frame parallel to the driveshaft;
(iv) a second spur gear mounted on the propeller shaft so as to engage the first spur gear; and (v) a worm gear attached to the propeller shaft and engaging the spur gear on the yoke; and (i) spaced apart first and second stops mounted on each side of the frame so that the spacing in each pair of stops is wider than the front axle and positioned so that when the motor is turning in a forward direction the front axle rotates in a forward direction, abuts the first stops on each side of the frame and is substantially parallel to the rear axle causing the vehicle to move forward in a substantially straight line, and when the rotation of the motor is reversed a torque acting on the spur gear and attached yoke will cause the yoke and attached front axle to pivot to a position where the front axle rests against the second stops on each side of the frame and is not parallel to the rear axle and will cause the front axle to rotate in a backward direction causing the vehicle to move in a backward direction and turn.

17. The vehicle of claim 16 also comprising:

(a) a rear axle spur gear attached to the rear axle;

(b) a second spur gear mounted on the frame and engaging the rear axle spur gear; and (c) a worm gear attached to the propeller shaft and engaging the second spur gear.

* * * * *